US010844654B1

(12) United States Patent
Smith et al.

(10) Patent No.: US 10,844,654 B1
(45) Date of Patent: Nov. 24, 2020

(54) CORNER KEY WITH DRAINAGE PATHWAY

(71) Applicant: JELD-WEN, Inc., Charlotte, NC (US)

(72) Inventors: Pete Smith, Charlotte, NC (US); Jacob Nelson, Klamath Falls, OR (US); David Belau, Klamath Falls, OR (US); Jerry Jones, Klamath Falls, OR (US); Ryan Schroeder, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 0 days.

(21) Appl. No.: 16/518,836

(22) Filed: Jul. 22, 2019

(51) Int. Cl.
*E06B 7/14* (2006.01)
*E06B 3/96* (2006.01)

(52) U.S. Cl.
CPC ..... *E06B 7/14* (2013.01); *E06B 3/9632* (2013.01)

(58) Field of Classification Search
CPC ..... E04B 7/14; E04B 1/70; E06B 3/9632; E06B 7/2316; E06B 3/96; E06B 3/964; E06B 3/9641; E06B 3/9642; E06B 7/14
USPC ..... 52/209
See application file for complete search history.

(56) References Cited

U.S. PATENT DOCUMENTS 1,291,511 A * 1/1919 Hester ..... E06B 7/02 454/196
1,368,444 A * 2/1921 Lawson ..... E06B 3/9632 52/209
3,410,027 A * 11/1968 Bates ..... E06B 7/14 49/471
3,845,599 A * 11/1974 Jolly ..... E06B 7/14 52/209
5,067,279 A * 11/1991 Hagemeyer ..... E06B 1/70 49/470
5,136,814 A * 8/1992 Headrick ..... E06B 1/70 49/468
5,283,977 A 2/1994 Smith
5,687,508 A 11/1997 Fitzhenry, Jr. et al.
5,779,384 A * 7/1998 Olsen ..... B29C 65/08 160/381
6,637,158 B2 10/2003 Bennett
6,763,639 B2 * 7/2004 Bennett ..... E06B 1/6092 160/92
6,789,358 B2 9/2004 Procton et al.
6,789,359 B2 9/2004 Bauman et al.
7,669,369 B2 * 3/2010 Henry ..... E06B 1/70 49/471

(Continued)

FOREIGN PATENT DOCUMENTS

EP 2246513 B1 1/2016
GB 2378975 2/2003

(Continued)

*Primary Examiner* — Ryan D Kwiecinski
(74) *Attorney, Agent, or Firm* — Stoel Rives LLP

(57) ABSTRACT

An assembly for a door or window frame including an elongated sill and a corner key attached to each end of the sill, where the corner keys each support a bottom end of a jamb. Each corner key includes a jamb-facing surface, a drain surface, and a sill-facing surface, the sill-facing surface extending between the jamb-facing surface and the drain surface. The corner key includes a chamber for collecting water therein and a drain port having an opening formed along the drain surface of the corner key, the drain port being in communication with the chamber for directing the water from the chamber out of the corner key.

15 Claims, 3 Drawing Sheets

(56) References Cited

U.S. PATENT DOCUMENTS 8,033,056 B2 * 10/2011 Wernlund ..... E06B 7/14 49/408
8,132,370 B2 3/2012 Heppner
8,375,659 B2 * 2/2013 Bogenhagen ..... E06B 7/2316 52/211
8,448,384 B2 5/2013 Wernlund et al.
8,499,498 B2 8/2013 Heppner
9,388,626 B2 7/2016 Gilbert et al.
9,487,992 B2 11/2016 Meeks
9,863,183 B2 1/2018 Johnson et al.
2002/0112421 A1 * 8/2002 Bennett ..... E06B 3/9632 52/204.1
2003/0005644 A1 * 1/2003 Reithmeyer ..... E05D 7/0027 49/467
2003/0106269 A1 * 6/2003 Bauman ..... E06B 7/14 49/467
2005/0115178 A1 * 6/2005 Schmidt ..... E06B 3/9641 52/272
2005/0198911 A1 9/2005 Baczuk et al.
2010/0162644 A1 * 7/2010 Campbell ..... E06B 1/70 52/209
2010/0325982 A1 * 12/2010 Bogenhagen ..... E06B 7/2316 52/211
2015/0096235 A1 4/2015 Rochman
2015/0159428 A1 * 6/2015 Johnson ..... E06B 7/10 49/471
2016/0273260 A1 9/2016 Jolie et al.
2016/0340970 A1 * 11/2016 Mitchell ..... E06B 3/9616
2017/0058592 A1 3/2017 Meeks
2017/0298676 A1 10/2017 Wilhelf et al.
2020/0190896 A1 * 6/2020 Kindt ..... E06B 3/9632

FOREIGN PATENT DOCUMENTS

WO 2006076496 A2 7/2006
WO 2009086510 A1 7/2009

* cited by examiner

CORNER KEY WITH DRAINAGE PATHWAY

TECHNICAL FIELD

The field of this disclosure relates generally to sill assemblies for doors and windows, and in particular, to such sill assemblies with water management features for diverting water away from the sill assembly in an effort to prevent water intrusion into the interior of the building or dwelling.

BACKGROUND

Conventional door systems, such as patio doors, typically include a sill assembly located along the lower portion of the door frame, where the sill assembly provides a transition between the exterior environment and the interior region of a building or dwelling. In some designs, sill assemblies help serve as a weather-proofing barrier for the doorway, where the sill assembly diverts water away from the door and interior of the building to avoid mildew, rot, or other water damage. Many conventional sill assembly designs are able to adequately handle minimal water and wind loads to minimize or restrict water intrusion. Some sill assemblies are designed with various drainage pathways to help resist water ingress from wind-driven rain and high differential pressures of the kind experienced in many coastal areas during tropical storms, typhoons, and hurricanes. However, many such designs are complex, are not well-suited for low-profile sills, and do not provide optimal performance for extreme weather conditions. In addition, other conventional designs fail to provide proper mechanisms to promote efficient water drainage, thereby resulting in water build-up and eventual water intrusion into the house or building.

Accordingly, the present inventors have identified a need for a low-profile sill assembly design incorporating a water management system to improve drainage and effectively divert water away from the sill assembly and doorway. The present inventors have also identified a need for such a sill assembly designed to restrict or fully eliminate water intrusion during severe storms that tend to bring large volumes of wind-driven rain. In addition, the present inventors have also identified a need for such a sill assembly having a streamlined design to minimize manufacturing costs and simplify installation. Additional aspects and advantages will be apparent from the following detailed description of example embodiments, which proceeds with reference to the accompanying drawings.

DETAILED DESCRIPTION OF EXAMPLE EMBODIMENTS

With reference to the drawings, this section describes particular embodiments of a sill assembly and its detailed construction and operation. Throughout the specification, reference to "one embodiment," "an embodiment," or "some embodiments" means that a particular described feature, structure, or characteristic may be included in at least one embodiment of the safety system. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
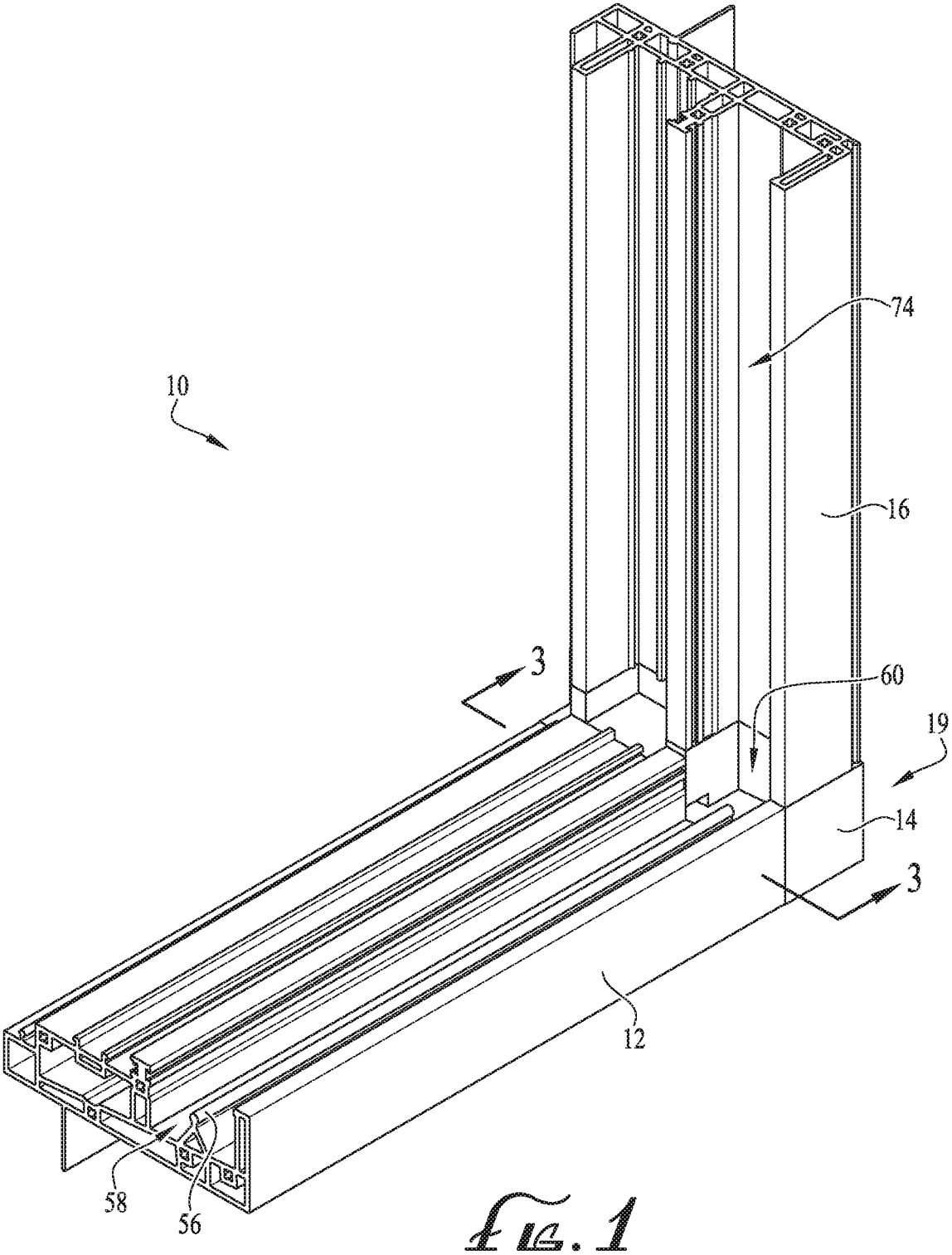
FIG. 1 is a perspective view of a corner portion of a sill assembly for a fenestration opening in accordance with one example embodiment.

FIGS. 1-4 collectively illustrate embodiments of a water management system for an assembly 10 that may be used for any suitable fenestration system, such as patio doors, for a building or dwelling. The assembly 10 includes a sill 12 and a pair of corner keys 14 (only one corner key is shown in FIG. 1), each corner key 14 being coupled or affixed to an end of the sill 12. Each corner key 14 is also coupled to and supports an upright jamb member 16 in a completed frame assembly. As further discussed in detail below, the assembly 10 is designed for diverting water away from an interior of a building or doorway. During extreme weather events, the exterior of the assembly 10 is subjected to air pressure and water concentrations. As these conditions continue for prolonged periods of time, a substantial pressure differential is created between the exterior environment (high pressure region) and interior environment (low pressure region) surrounding the assembly 10. This pressure differential may result in water being force through the assembly 10, such as through small openings or seams at various adjoining surfaces, and into the building or dwelling regardless of the presence of sealing structures or weatherstrips on the assembly 10 designed to restrict such water flow. Because sill systems are not effective at completely sealing all water out, especially during severe storms, a water management system is employed to handle any water that has entered the assembly 10 and allow it to drain away and back to the exterior environment.

The following passages provide a brief description of various features of the overall system, followed by a more thorough description of each component and their interoperability to achieve the water management features described above.

As further detailed below with reference to the figures, the water management features for the overall door system are primarily built into the corner keys 14 for managing internal/external pressure differentials to maximize water performance of the overall assembly 10 without requiring complex weep designs integrated into the sill or stepped joinery at the jamb-sill intersection of the fenestration structure. Accordingly, this versatility allows for easier installation and simplifies jamb and sill-end work. Briefly, the corner key 14 is designed to store a column of water in a rear reservoir or sill water chamber 60, where the water builds static head pressure as it accumulates in the water chamber 60. The water management system then uses this static head pressure built by the column of water to overcome the pressure differential across the assembly 10, and drive water out of the assembly 10 through a drain port 70 in the corner key 14. Depending on the amount of static head pressure built in the water chamber 60, some water may be driven out of the assembly 10 even as water continues to flow in. In some embodiments, the water chamber 60 may be in communication with a vent 74 formed on an interior portion of the jamb 16, where the vent 74 is designed to help further relieve the pressure in the sill 12, thereby reducing the overall pressure differential and allowing for higher water flow rate out of the sill 12. Additional details of each of these components and other embodiments relating to the sill 12 and corner keys 14 are described in further detail below with reference to the figures.

Figure 2:
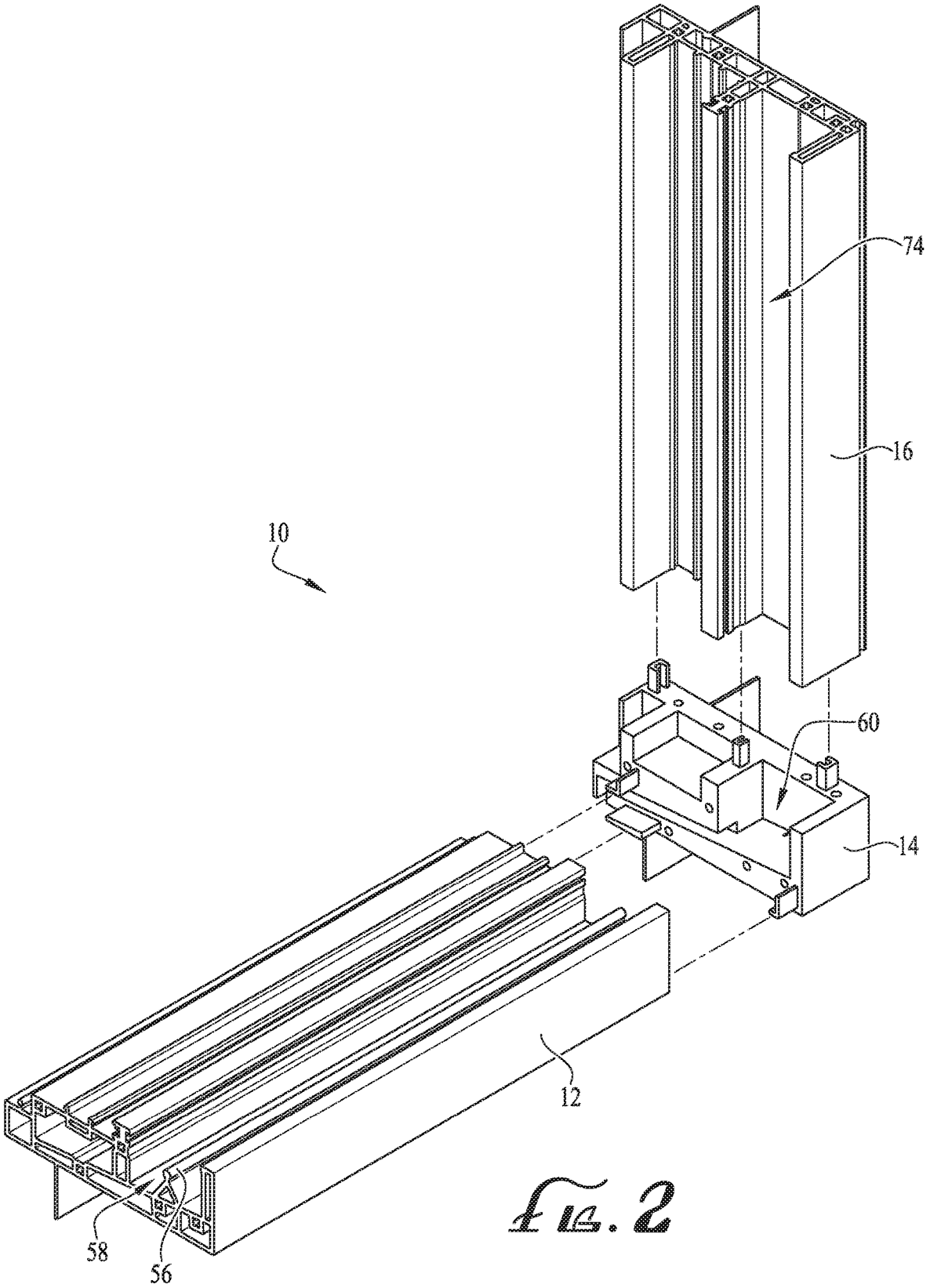
FIG. 2 is an exploded view of the sill assembly of FIG. 1 illustrating various details of a corner key coupled to the sill and jamb.

FIGS. 1 and 2 collectively illustrate a corner portion of an assembly 10 for use in an entryway, such as for patio doors, of a building or dwelling. The assembly 10 includes an elongated sill 12 made of any one of a variety of materials, such as polyvinyl chloride (PVC), pultruded fiberglass, aluminum or any other suitable materials. A corner key 14 is coupled to the sill 12 at a first end 18 and at an opposite second end (not shown). It should be understood that features of the corner key 14 illustrated in FIGS. 1 and 2 apply equally to a second corner key (not shown) coupled along the second end of the sill 12. The corner key 14 essentially serves as an end cap for the sill 12 and also serves to support a door jamb 16 when the door frame structure is fully assembled (as further described with reference to FIG. 2). The corner keys 14 are preferably manufactured as a single, integral structure and may be made of any suitable material, such as an injection molded plastic material.

Figure 3:
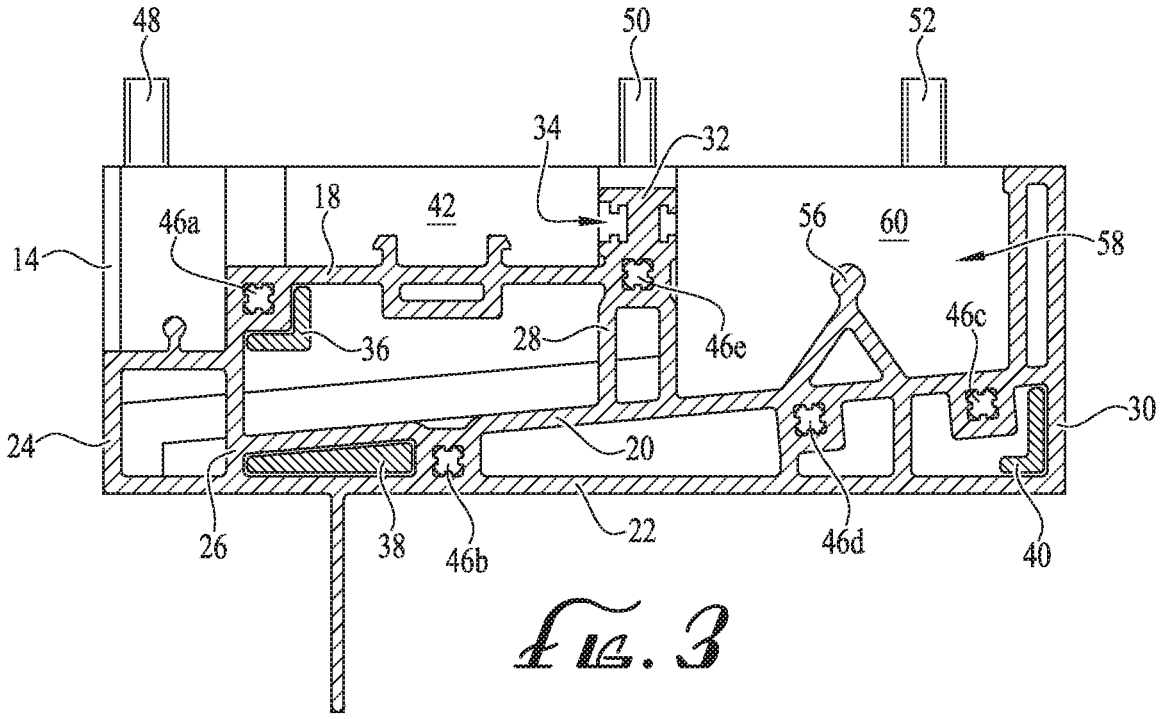
FIG. 3 is a cross-sectional detail view of the sill assembly cut along sectioning lines A-A of FIG. 1 illustrating details of a mated sill and corner key configuration.

FIG. 3 is a cross-sectional view of the sill assembly 12 cut along sectioning lines A-A of FIG. 1 illustrating details of a mated sill and corner key configuration. With reference to FIG. 3, the following describes details for securing the corner keys 14 to the sill 12 in accordance with one embodiment. With reference to FIG. 3, the sill 12 includes a first elongated frame member 18, a second elongated frame member 20, and a third elongated frame member 22, each of which extending along a generally horizontal axis. The sill 12 also includes a plurality of vertical legs 24, 26, 28, 30 extending between the frame members 18, 20, 22, where the legs 24, 26, 28, 30 collectively support the frame members 18, 20, 22 and form an overall profile of the sill 12. As illustrated, the sill 12 may include additional vertical legs than those enumerated above. For purposes of clarity and simplicity, only certain vertical legs of the sill 12 have been enumerated. The sill 12 further includes a seal housing 32 formed thereon, the seal housing 32 including grooves 34 for receiving and securing a weatherstrip or seal (not shown) that extends upwardly therefrom and across the sill 12 between the corner keys 14 to help divert water and debris away from the interior of the dwelling or building. The sill 12 also includes a rail 56 positioned within a channel 58 formed between vertical legs 28, 30 of the sill 12. The rail 56 is designed to support a roller (not shown) of a sliding door or panel (not shown).

Figure 4:
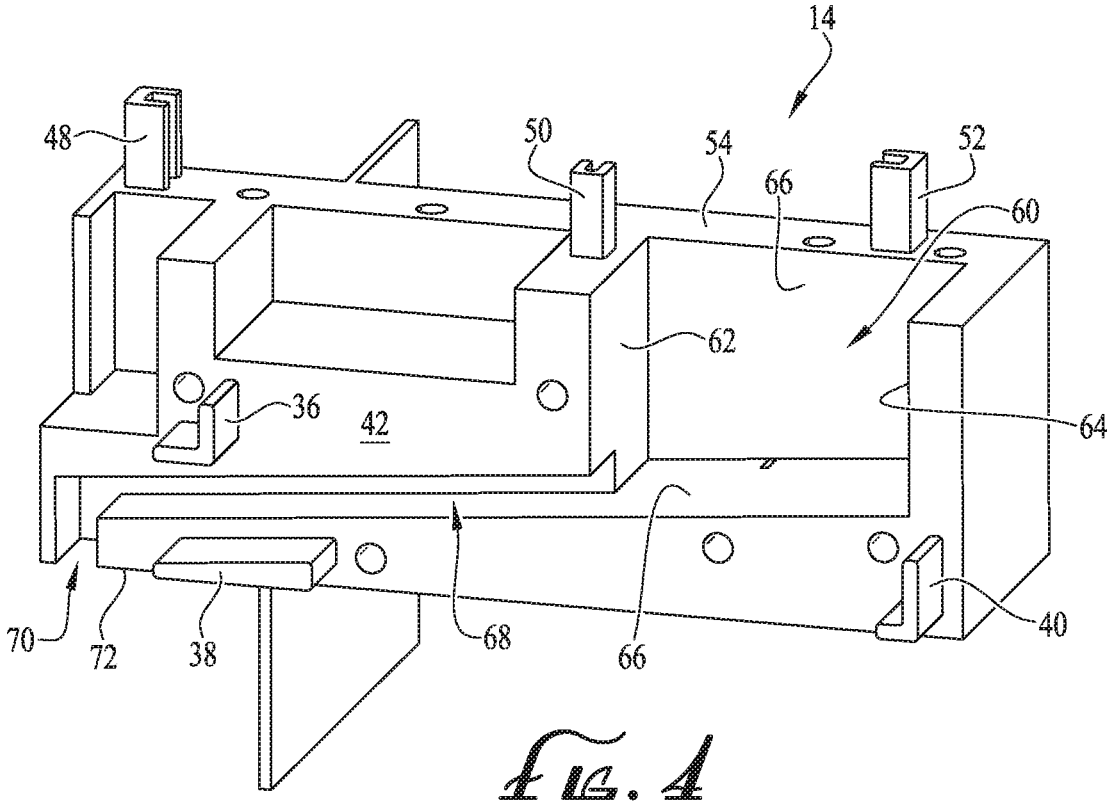
FIG. 4 is a perspective view of the corner key of FIG. 1 in accordance with one embodiment.

The corner key 14 includes a plurality of mounts 36, 38, 40 formed thereon as integral components of the corner key 14, where each of mounts 36, 38, 40 protrudes or extends outwardly from a sill-facing side surface 42 of the corner key 14 (see also FIG. 4). When the corner key 14 is coupled to the sill 12, the mounts 36, 38, 40, sit against and engage various members of the sill 12 to help support and stabilize the corner key 14 in position against the sill 12. For example, with reference to FIG. 3, mount 36 rests against a rib portion extending down from the frame member 18 and against a rib portion extending outwardly from the vertical leg 26. Similarly, mount 38 is fitted into a slot (not shown) formed between the frame members 20, 22 and a lower portion of the vertical leg 26, and mount 40 sits against the junction of the frame member 22 and vertical leg 30. Once the corner key 14 is in position, a plurality of fasteners (not shown) are used to securely mount the corner key 14 and sill 12 to one another at various attachment points 46*a*, 46*b*, 46*c*, 46*d*, 46*e*.

The corner key 14 further includes a plurality of posts 48, 50, 52 formed thereon, each of which protruding or extending upwardly from a jamb-facing top surface 54 of the corner key 14 (see also FIG. 4). The posts 48, 50, 52 are designed to slot into corresponding openings (not shown) formed on a bottom surface (not shown) of the jamb 16. Thereafter, fasteners (not shown) may be used to couple the corner key 14 and the jamb 16 together.

It should be understood that the particular arrangement of the interior profile of the sill 12 illustrated in FIG. 3, and the location and design of the mounts 36, 38, 40 and posts 48, 50, 52 are for illustration purposes only and not intended to be limiting. One having ordinary skill in the art may make changes to the sill profile and the corner key 14 without departing from the principles of the disclosed subject matter.

With particular reference to FIGS. 3-4, the following provides details of the water management features incorporated into the corner key 14 and their operation for managing water ingress. With reference to FIG. 4, the corner key 14 includes a rear chamber 60 designed to collect and store water entering into the sill 12 (e.g., via wind-driven rain or a storm event). With reference to FIG. 4, the rear chamber 60 may be bounded between a front wall 62, an opposite rear wall 64, and a side wall 66 extending between the front and rear walls 62, 64. In some embodiments, the chamber 60 is formed such that it is partially or fully open along the sill-facing side surface 42 and the jamb-facing top surface 54.

In this arrangement, when the corner key 14 and sill 12 are coupled to one another, the open sill-facing portion of the rear chamber 60 is aligned with and in communication with the channel 58 of the sill 12 (see FIG. 3), which may help collect into the rear chamber 60 any water and debris present in the channel 58. Other internal cavities of the sill 12 may also be in communication either with the rear chamber 60 or the passageway 68 to help direct water out of the drain port 70. Similarly, when the corner key 14 and jamb 16 are coupled, the open jamb-facing portion of the rear chamber 60 may be aligned with and in communication with a vent 74 (see FIG. 2) running along an interior portion of the jamb 16. As further described in detail below, the rear chamber 60 and vent 74 may work together to help manage the pressure gradient in the sill 12 and improve overall water performance of the assembly 10. The side walls of the vent 74 may also help trap and collect any water droplets that may be carried by the air moving through the assembly 10 and deposit them within the rear chamber 60.

As noted previously, during an intense storm event, the pressure differential between the exterior environment (typically a high-pressure zone) and the interior environment (typically a low-pressure zone) may cause water and wind-driven rain to enter the sill 12. If the water cannot be drained at a sufficient rate, the sill 12 will eventually overflow and water will enter the building or other dwelling. As further described in detail below, the sill 12 and corner key 14 are designed to help improve water management and maintain the integrity of the assembly 10. With particular reference to FIGS. 3-4, the following provides details of the water management features of the assembly 10 for preventing water from entering into the building or dwelling.

As noted previously, the assembly 10 functions as a self-draining system for an exterior door of a building or dwelling. When minimal water enters the sill 12, the overall slanted profile of the sill 12 is capable of directing the water outwardly to the exterior environment and away from the interior portion of the building. If the water 48 penetrates entirely through to the rear of the sill 12, the water accumulates in the rear chamber 60 of the corner key 14. Under normal conditions (e.g., no substantive differential pressure between the interior and exterior portions of the assembly 10), the accumulated water is directed down a ramped surface 66 of the rear chamber 60 and toward the front wall 62. The corner key 14 includes a passageway 68 formed therein, the passageway 68 directing water from the ramped surface 66 to a drain port 70, whereat the water exits into the exterior environment.

Preferably, the drain port 70 is formed on a bottom drain surface 72 of the corner key 14, where the bottom drain surface 72 is opposite the jamb-facing top surface 54 such that the respective surfaces 54, 72 are positioned along parallel planes relative to one another. In this configuration, the sill-facing side surface 42 is generally orthogonal to both the surfaces 54, 72, as it extends between the jamb-facing top surface 54 and the drain surface 72. Positioning the drain port 70 along the drain surface 72 serves to minimize water intrusion into the sill 12 and allows the weep holes to be hidden for a more aesthetically pleasing design.

Under extreme weather conditions, however, wind-driven rain against the exterior portion of the sill 12 may allow water to permeate through weatherstrips or other imperfect seals, such as at the junction of the sill 12 and the corner keys 14, and enter the sill 12 at an accelerated rate. Moreover, wind forces exerted on the exterior of the sill 12 cause an air pressure differential across the assembly 10, with higher air pressure exerted on the exterior of the building than on the interior of the building. This pressure differential causes water to move even more rapidly from the exterior to the interior of the building. This water movement continues until the pressure is equalized between the interior and exterior of the building. During these pressure conditions, water cannot effectively drain naturally, and so it accumulates within the sill 12.

Turning to FIGS. 3 and 4, the incoming water accumulates in the rear chamber 60 at the rear portion of the sill 12. Over time, the water level in the rear chamber 60 rises as water continues moving into the sill 12 due to wind and increasing pressure differentials. As the water column rises in the rear chamber 60, it builds a head pressure that serves to counter the high pressure areas building in the sill 12. As described previously, the rear chamber 60 and vent 74 may help temper the high pressure gradient by directing air flow upwardly through the vent 74. This process helps reduce the pressure gradient by connecting the high pressure regions of the sill 12 to lower pressure areas, thereby allowing the pressure differential within the sill 12 to quickly stabilize. As the air flows through the pathway, any droplets of water that it may be carrying are trapped and collected either by the walls of the passageway 68, the walls of the rear chamber 60 or the walls of the vent 74, thereby minimizing droplet infiltration into the interior of the dwelling, as noted previously.

As the water continues to rise in the rear chamber 60, the water column builds head pressure in the water chamber 32 to help equalize, and eventually overbalance the pressure gradient in the sill 12, thereby helping to expel water away from the sill 12. Over time, the water column produces sufficient head pressure to overcome the air pressure differential between the interior and exterior portions of the sill 12 and reverse the migration of water.

Accordingly, the rear chamber 60 plays a key role in managing the overall performance of the sill 12, as the selected height of the rear chamber 60 determines how much head pressure it can build. If the rear chamber 60 is not sufficiently tall, then the water column in the rear chamber 60 may not build sufficient head pressure to overcome the air pressure differentials created by the weather event, at which point the rear chamber 60 will overflow and allow water to infiltrate the interior of the sill 12 and the building. Accordingly, the height H of the rear chamber 60 is preferably selected to allow for sufficient water build-up and head pressure to overcome air pressure differentials in a given region. In some embodiments, local weather data may be used to determine anticipated air pressure differentials to calculate an appropriate height for the rear chamber 60 to ensure that the water will build sufficient head pressure to avoid water intrusion into the interior of the building or dwelling. In some embodiments, the height of the rear chamber 60 may be designed for specific DP ratings of the door. Generally speaking, the higher the DP rating, the taller the rear chamber 60 should be to allow for building of sufficient head pressure in the rear chamber 60 to avoid overflow.

It is intended that subject matter disclosed in particular portions herein can be combined with the subject matter of one or more of other portions herein as long as such combinations are not mutually exclusive or inoperable. In addition, many variations, enhancements and modifications of the lighted shelf assembly concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. An assembly for a door or window frame, comprising:
- an elongated sill having a first end and an opposite second end;
- a jamb having a bottom end and an opposite top end; and
- a corner key having a jamb-facing surface formed at a top end of the corner key and a drain surface formed at an opposite bottom end of the corner key, the corner key further including a sill-facing surface extending between the jamb-facing surface and the drain surface, wherein the first end of the sill is coupled to the corner key along the sill-facing surface thereof, and wherein the bottom end of the jamb is coupled to the top end of the corner key along the jamb-facing surface thereof, the corner key further comprising:
  - a chamber formed in the corner key, the chamber defining a reservoir for collecting water therein; and
  - a drain port having an opening formed along the drain surface at the bottom end of the corner key, the drain port in communication with the chamber and operable to direct the collected water from the chamber and out of the assembly along the bottom end of the corner key.

2. The assembly of claim 1, wherein the chamber of the corner key is bounded by a front wall, an opposite rear wall, and a side wall extending from the front wall to the rear wall, the chamber being open along the sill-facing surface and the jamb-facing surface of the corner key.

3. The assembly of claim 1, wherein the chamber of the corner key is bounded by a front wall, an opposite rear wall, and a side wall extending from the front wall to the rear wall, the front wall further including a passage formed therethrough, the passage extending from the chamber to the drain port.

4. The assembly of claim 3, wherein the passage further includes a ramped floor, the floor sloping downwardly from the chamber to the drain port.

5. The assembly of claim 4, wherein the passage and the chamber are both open along the sill-facing surface of the corner key.

6. The assembly of claim 5, wherein the sill further includes one or more internal cavities, wherein at least one of the one or more internal cavities is in communication with either the chamber or the passage.

7. The assembly of claim 1, further comprising a plurality of mounts formed along the sill-facing surface of the corner key, each of the mounts extending outwardly therefrom and coupling with one or more legs of the sill to support the sill and corner key in a mated configuration.

8. The assembly of claim 1, further comprising a plurality of posts formed along the jamb-facing surface of the corner key, each of the posts extending upwardly therefrom and operable to support the jamb and corner key in a mated configuration.

9. The assembly of claim 1, wherein the jamb further includes a vent having an open pathway formed along an interior portion of the jamb, the vent having a first opening formed along the bottom end of the jamb, wherein the vent opening is in communication with the chamber of the corner key when the corner key and jamb are in a mated configuration, the vent directing air flow from the chamber and upwardly along the jamb.

10. The assembly of claim 9, wherein the vent further includes a second opening formed along the top end of the jamb.

11. The assembly of claim 1, the sill further comprising a rail channel extending from the first end to the second end of the sill and a rail formed therein, wherein the rail channel is in communication with the chamber of the corner key when the sill and corner key are in a mated configuration.

12. The assembly of claim 1, wherein the sill-facing surface is disposed generally orthogonal to the jamb-facing surface and the drain surface.

13. The assembly of claim 1, wherein the chamber of the corner key is in communication with a channel of the elongated sill.

14. The assembly of claim 13, wherein the sill further includes a rail positioned within the channel, the rail configured for supporting a door or window.

15. The assembly of claim 1, wherein the jamb-facing surface and the drain surface are positioned along parallel planes relative to one another.

* * * * *